US005282724A

United States Patent [19]

Reynolds

[11] Patent Number: 5,282,724

[45] Date of Patent: Feb. 1, 1994

[54] MODULAR CHECK VALVE SYSTEM

[75] Inventor: Steven M. Reynolds, Mansfield, Ohio

[73] Assignee: Warren Rump, Inc., Mansfield, Ohio

[21] Appl. No.: 881,717

[22] Filed: May 12, 1992

[51] Int. Cl.[5] ..... F04B 21/00

[52] U.S. Cl. ..... 417/454; 417/563

[58] Field of Search ..... 417/454, 563, 569, 570, 417/571; 137/533.11, 533.13

[56] References Cited

U.S. PATENT DOCUMENTS

| | | | |
|---|---|---|---|
| 2,018,769 | 10/1935 | Tyron | 137/533.11 |
| 2,569,734 | 10/1951 | Saalfrank | 137/315 |
| 3,055,391 | 9/1962 | Shuk et al. | 137/516.25 |
| 3,196,896 | 7/1965 | Leutenegger | 137/271 |
| 3,993,091 | 11/1976 | Loveless | 137/269 |
| 3,995,654 | 12/1976 | Arvin et al. | 137/270 |
| 4,063,568 | 12/1977 | Sosulnikov et al. | 137/270 |
| 4,336,818 | 6/1982 | Dauvergne | 137/38 |
| 4,825,897 | 5/1989 | Shade | 137/271 |
| 4,832,075 | 5/1989 | Dubach | 137/512 |
| 4,936,753 | 6/1990 | Kozumplik, Jr. et al. | 417/454 |

*Primary Examiner*—Richard A. Bertsch
*Assistant Examiner*—Charles G. Freay
*Attorney, Agent, or Firm*—Hill, Steadman & Simpson

[57] ABSTRACT

A modular check valve system includes a plurality of modular check valves all having a common stack height. The common stack height allows for a substitution of individual valve modules. The substitution capability provides an economical way to increase or decrease the flow area through the valve assembly by varying size of the ball within the check valve. Thus, the specifications of the pump can be relatively easily changed, either at the factory or in the field. The modular construction also permits the use of different types of valves (e.g. flap valves, poppets, duckbills, or trihedrals) without having to change any additional pump fittings. In one embodiment, the modular valve system of the present invention is described in conjunction with a pump having at least one fluid communication fitting adapted to receive a check valve assembly. A fluid passage adjacent to, and adapted for a fluid communication with, the fitting includes a terminal end spaced a predetermined distance from the fitting, to define a predetermined dimensional envelope. A plurality of ball check valves having different sized ball valve elements contained therein is provided. Each of the valves includes a valve housing having a stack height and exterior cross section corresponding to the predetermined dimensional envelope. Any one of the plurality of valves can be secured in the predetermined dimensional envelope to determine the flow velocity and flow area of fluid passing through the pump.

5 Claims, 2 Drawing Sheets

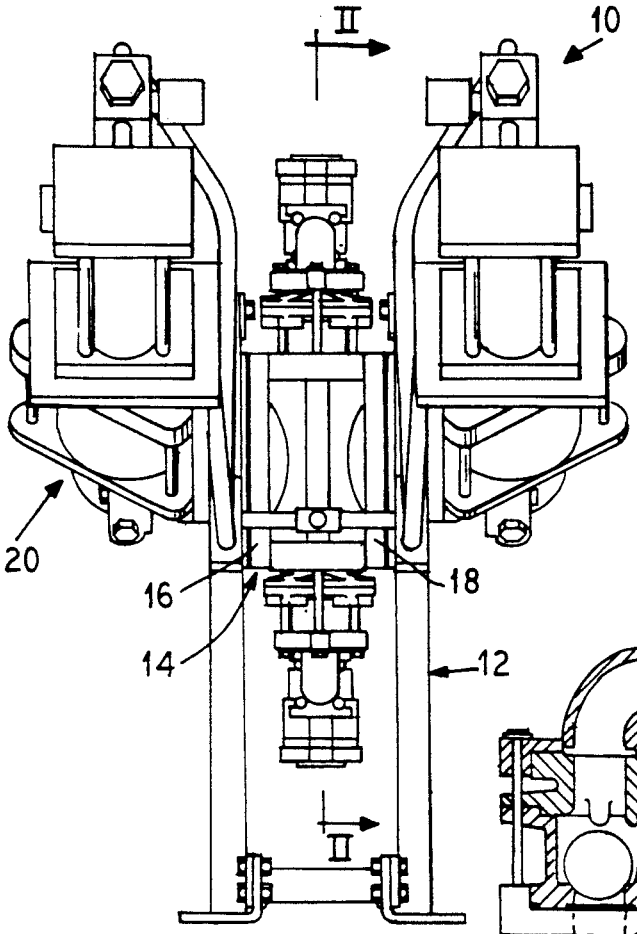
FIG. 1
FIG. 2
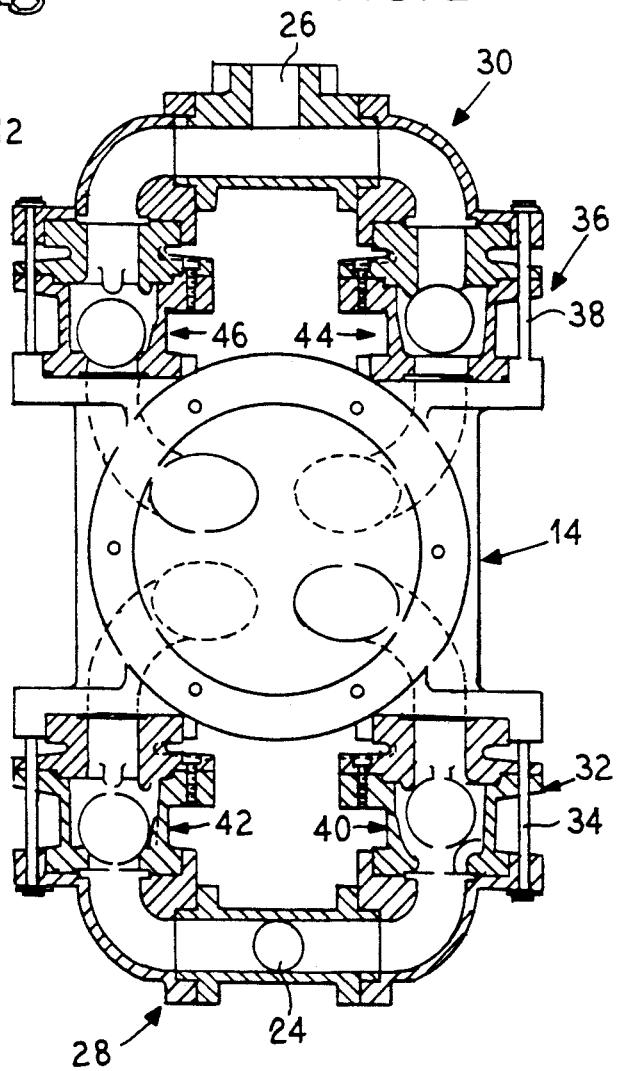

MODULAR CHECK VALVE SYSTEM

FIELD OF THE INVENTION

The present invention relates to a modular check valve system, and particularly to a system in which valves having various flow characteristics fit within a common dimensional envelope.

BACKGROUND OF THE INVENTION

Check valves, particularly ball check valves, are used in a wide variety of fluid flow systems to control and regulate fluid flow. In pump systems, ball check valves are often used to regulate not only on-off flow control, but to regulate other flow characteristics as well. For example, the clearance between the ball valve element and the interior of the valve housing can be used to determine flow rate through the valve, and also to limit the size of solids that can flow through the valve.

In known pump systems, the sizes of the various valves that may be used with a single pump block vary greatly. In such systems, the housing block and/or the inlet and outlet manifolds of the pumps have had to be provided with fittings of different sizes to accommodate the various valves. Thus, if the user of the pump miscalculated the pump requirements, or if the pump requirements changed over time, the user had no recourse but to replace the pump, or replace a substantial number of pump components, in order to change check valves to meet these requirements.

From the foregoing, it can be seen that there exists a need for a modular check valve system in which only the valve unit itself needs to be replaced to change the pump characteristics.

SUMMARY OF THE INVENTION

The present invention is directed to a plurality of modular check valves all having a common stack height. The common stack height allows for a substitution of individual valve modules. The substitution capability provides an economical way to increase or decrease the flow area through the valve assembly by varying the size of the ball within the check valve. Thus, the specifications of the pump can be relatively easily changed, either at the factory or in the field. The modular construction also permits the use of different types of valves (e.g. flap valves, poppets, duckbills, or trihedrals) without having to change any additional pump fittings.

In one embodiment, the modular valve system of the present invention is described in conjunction with a pump having at least one fluid communication fitting adapted to receive a check valve assembly. A fluid passage adjacent to, and adapted for a fluid communication with, the fitting includes a terminal end spaced a predetermined distance from the fitting, to define a predetermined dimensional envelope. A plurality of ball check valves having different sized ball valve elements contained therein is provided. Each of the valves includes a valve housing having a stack height and exterior cross section corresponding to the predetermined dimensional envelope. Any one of the plurality of valves can be secured in the predetermined dimensional envelope to determine the flow velocity and flow area of fluid passing through the pump.

Other advantages of the present invention will be apparent upon reference to the accompanying description when taken in conjunction with the following drawings.

BRIEF DESCRIPTION OF THE DRAWINGS

FIG. 1 illustrates an elevational view of a pump incorporating check valves embodying the principles of the present invention.

FIG. 2 illustrates a cross sectional view taken generally alone line II—II of FIG. 1.

DESCRIPTION OF THE PREFERRED EMBODIMENT

Figure 5:
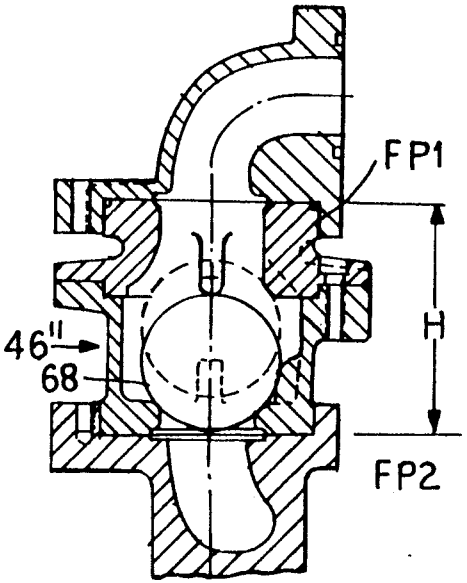
FIGS. 3 through 5 illustrate sectional views of different check valve modules installed in identical fittings.

FIG. 1 illustrates an elevational view of a double diaphragm pump 10 using the module check valve system of the present invention. The pump 10 is described in detail in U.S. patent application Ser. No. 07/871,191, filed Apr. 20, 1992, specification of which is incorporated by reference herein. The pump 10 is mounted on a frame assembly 12, and includes a central housing block assembly 14, with a pair of diaphragm housings 16, 18 secured to respective sides of the central housing block. A pair of drive assemblies 20, 22 are associated with the respective diaphragm housings, and are adapted to provide motive force to the respective diaphragms.

As shown in FIG. 2, the central housing block assembly 14 includes a fluid inlet 24 and a fluid outlet 26. The fluid inlet 24 is formed in an inlet manifold 28, and the fluid outlet 26 is formed in an outlet manifold 30. The inlet manifold 28 is, in turn, connected to a lower valve assembly 32 by bolts 34 or other suitable securing mechanisms. The outlet manifold 30 is connected to an upper valve assembly 36 by bolts 38 or other suitable securing mechanisms. The lower valve assembly 34 and the upper valve assembly 36 are identical in construction, but act in an inlet or outlet capacity by virtue of their attached valve construction, to be described below.

The lower valve assembly 32 includes a pair of inlet valve modules 40 and 42. The upper valve assembly 36 includes a pair of outlet valve modules 44 and 46.

Figure 3:
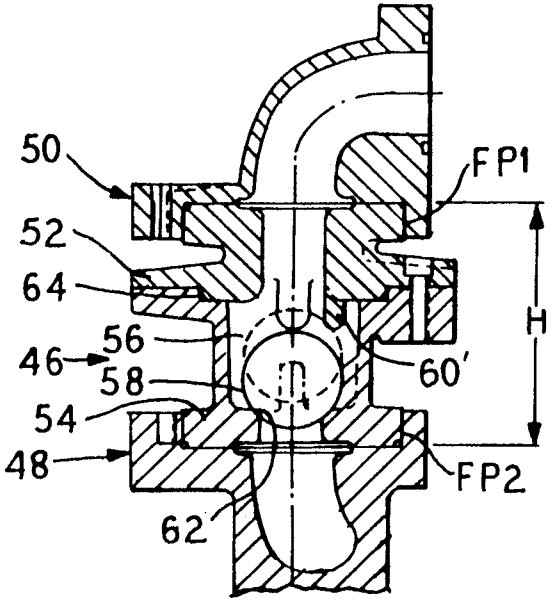

The valve module 46 is shown in detail in FIG. 3. The valve module 46 is secured between an outlet fitting 48 formed on the central housing block 14 of the pump 10, and a terminal end 50 of the outlet manifold 30. The valve module 46 includes an upper housing section 52 and a lower housing section 54. The upper housing section 52 and lower housing section 54 together provide a valve chamber 56 in which a ball valve element is disposed. The upper housing 52 is provided with a plurality of ball support elements 60, which serve to support the ball valve element 58 when fluid flowing through the system moves the ball valve element 58 to its open position (shown in broken line). The lower housing section 54 is provided with a valve seat 62, which provides a seating surface for the ball valve element 58 in its closed position. An O-ring 64 or other suitable sealing element is provided between the upper and lower housing sections to affect a fluid tight seal.

The exterior cross section of the module 46 defines a first fitting profile FP1, and a second fitting profile FP2. The valve module 46 also defines a predetermined stack height H. As illustrated, the first and second fitting profiles are provided as identical generally annular flanges. This allows the valve module 46 to be reversible, i.e. to be secured in a first orientation in which the valve module is biased by the force of gravity to be normally open, and a second orientation in which the valve module is normally closed. Thus, the valve modules 40, 42, 44 and 46 shown in FIG. 2 are of identical construction, with their function as either inlet or outlet valves being defined merely by their orientation rather than their structure.

Figure 4:
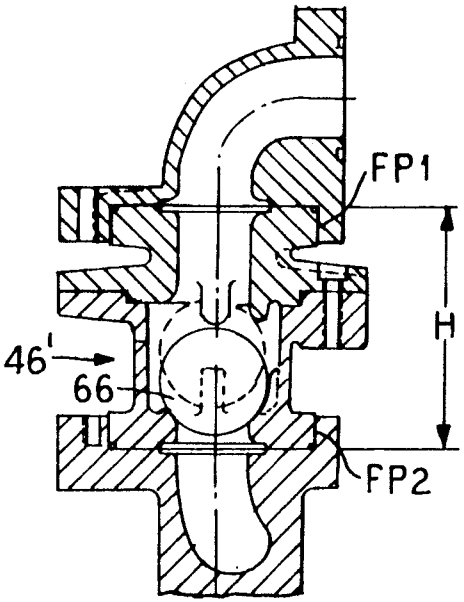

FIGS. 4 and 5, along with FIG. 3, illustrate the capability of the modular check valve system of the present invention to be used to easily adapt pump systems to different flow characteristics. In FIG. 4, a valve module 46' has the same dimensional envelope as the valve modules 40 through 46. Specifically, the valve module 46' has the same fitting profiles FP1 and FP2, and the same stack height H. However, the valve module 46' includes a ball valve element 66 that is substantially larger in diameter than the ball valve element 58. The larger ball valve element 66 prevents the flow of solids through the valve module 46' of a size that would pass through the valve module 46. Furthermore, the fluid flow rate through the valve module 46' is less than that through the valve module 46. However, the valve module 46 and the valve module 46' have a common dimensional envelope, thus allowing them to be interchanged.

Similarly, the valve module 46" shown in FIG. 5 includes an even larger ball valve element 68, while maintaining an identical dimensional envelope by virtue of identical fitting profiles FP1, FP2 and stack height H. As with the valve module 46', the valve module 46" has solids handling and flow characteristics that differ-very significantly from those of the valve module 46. Although the dimensions of the various check valves intermediate their ends may also vary significantly, their stack heights and fitting profiles are identical. Thus, all of the valve modules shown in FIGS. 3 through 5 are both interchangeable with one another and reversible.

The interchangeability and reversibility of the illustrated valve modules permits a pump manufacturer to fabricate pumps having a standard central block and inlet and outlet manifolds. The pump characteristics can then be selected by determining the ball valve size that is most suitable to the individual pump specification, and then securing the valve module corresponding to the desired flow characteristics in the standard pump fittings.

Similarly, the end user of the pump can adapt the standard pump as originally provided to changing pump specifications by merely substituting valve modules corresponding to the desired specifications. This eliminates the need to either replace the pump or replace a substantial number of pump fittings.

It is to be understood that the foregoing examples are merely illustrative, and that the principles of the invention are capable of almost endless modification. The housing sections and the ball valve element could be manufactured from any suitable plastic or metal, thus permitting them to be adapted to, for example, sanitary conditions. It is also contemplated that the valve housing sections could be "shimmed" between the halves to allow for valve travel adjustment. It is also contemplated that the modular construction of the system permits the use of different types of valves, for example flap valves, poppets, duckbill valves, or trihedral valves, without having to provide specially manufactured housing blocks of manifolds.

Although the present invention has been described with reference to a specific embodiment, those of skill in the art will recognize that changes may be made thereto without departing from the scope and spirit or the invention as set forth in the appended claims.

I claim as my invention:

1. In a pump assembly including a pump having an inlet and an outlet and a flow section at at least one of said inlet and outlet defining a predetermined dimensional envelope, a method of installing valve assemblies to selectively modify the flow characteristics of said pump comprising the following steps:

providing a plurality of valve modules, each of said valve modules having a valve housing with a stack height and exterior dimension corresponding to said predetermined dimensional envelope of said pump flow section, each of said valve housings containing respective valve elements providing different flow characteristics; and selecting one of said plurality of valve modules and securing it within said predetermined dimensional envelope of said pump flow section to provide a selected flow characteristic for said pump assembly given a particular flow rate and material to be moved by said pump assembly.

2. A method according to claim 1, wherein said step of providing a plurality of valve modules comprises providing a plurality of valve modules wherein each of said valve housings contains ball valve elements of different sizes.

3. A method according to claim 1, wherein said step of providing a plurality of valve modules comprises providing valve modules having various types of valve elements from the group consisting of ball valves, flat valves, duck bill valves and trihedral valves.

4. A method according to claim 1, wherein said pump assembly has said flow section at both said inlet and outlet and said step of selecting valve modules comprises selecting a valve module and securing it within said predetermined dimensional envelope at said inlet and also selecting a valve module and securing it within said dimensional envelope at said outlet.

5. A method according to claim 1, wherein said step of providing a plurality of valve modules includes providing modules having first and second fitting profiles at opposite ends of each of said valve modules wherein said first fitting profiles are identical to said second fitting profiles and wherein said step of securing said valve module within said predetermined dimensional envelope includes securing it in one orientation to provide flow through said pump in a first direction and securing said valve module in an opposite orientation to provide a reverse flow through said pump.

* * * * *